US008161669B2

(12) United States Patent
Keating

(10) Patent No.: US 8,161,669 B2
(45) Date of Patent: Apr. 24, 2012

(54) INFANT SHOE HAVING A PIVOTING HEEL PORTION

(75) Inventor: Brian Keating, West Hills, CA (US)

(73) Assignee: X-Swiss, Inc., Westlake Village, CA (US)

( * ) Notice: Subject to any disclaimer, the term of this patent is extended or adjusted under 35 U.S.C. 154(b) by 794 days.

(21) Appl. No.: 11/970,984

(22) Filed: Jan. 8, 2008

(65) Prior Publication Data

US 2008/0168683 A1 Jul. 17, 2008

Related U.S. Application Data

(60) Provisional application No. 60/884,500, filed on Jan. 11, 2007.

(51) Int. Cl.
*A43B 1/10* (2006.01)
*A43B 3/30* (2006.01)

(52) U.S. Cl. ..... 36/112; 36/102

(58) Field of Classification Search ..... 36/114, 36/58.5, 58.6, 112, 50.1, 102, 138
See application file for complete search history.

(56) References Cited

U.S. PATENT DOCUMENTS

| | | | | |
|---|---|---|---|---|
| 1,585,049 | A * | 5/1926 | Skoglund | 36/58.5 |
| 2,357,980 | A | 9/1944 | Spiro | |
| 2,450,250 | A | 10/1948 | Napton | |
| 3,349,505 | A | 10/1967 | Lopez | |
| 3,681,860 | A | 8/1972 | Bidegain | |
| 4,136,468 | A | 1/1979 | Munschy | |
| 4,599,811 | A * | 7/1986 | Rousseau | 36/105 |
| 4,649,656 | A * | 3/1987 | Cox et al. | 36/4 |
| 4,665,634 | A | 5/1987 | Diaz | |
| 5,090,140 | A * | 2/1992 | Sessa | 36/138 |
| 5,184,410 | A | 2/1993 | Hamilton | |
| 5,481,814 | A | 1/1996 | Spencer | |
| 5,557,866 | A * | 9/1996 | Prengler | 36/138 |
| 5,570,523 | A | 11/1996 | Lin | |
| 5,682,687 | A | 11/1997 | Arai | |
| 5,813,144 | A * | 9/1998 | Prengler | 36/88 |
| 6,189,239 | B1 | 2/2001 | Gasparovic et al. | |
| 6,594,921 | B2 * | 7/2003 | Laio et al. | 36/138 |
| 6,718,658 | B2 * | 4/2004 | Karasawa | 36/97 |
| 7,101,604 | B1 | 9/2006 | Minges | |
| 7,127,837 | B2 * | 10/2006 | Ito | 36/101 |
| 7,607,242 | B2 * | 10/2009 | Karandonis et al. | 36/105 |
| 2004/0148805 | A1 | 8/2004 | Morris | |

FOREIGN PATENT DOCUMENTS

| | | |
|---|---|---|
| CN | 2052208 U | 2/1990 |
| DE | 33 10988 A1 | 9/1984 |

OTHER PUBLICATIONS

Chinese Office Action Issued on Mar. 8, 2011 in Application No. 200880003743.7.

* cited by examiner

*Primary Examiner* — Jila Mohandesi
(74) *Attorney, Agent, or Firm* — Rothwell, Figg, Ernst & Manbeck, P.C.

(57) ABSTRACT

A shoe such as an infant's shoe includes a sole and an upper with the upper formed by a forefoot portion and a heel portion. When an infant's foot is to be placed in the shoe, the heel portion is configured to be pivoted with respect to the forefoot portion to an open position to allow the foot to slide into the forefoot portion. According to an example, after the foot is received in the forefoot portion, the heel portion is pivoted to a substantially closed position and one or more securing devices associated with each of the forefoot portion and heel portion are engaged to secure the shoe on the infant's foot.

24 Claims, 3 Drawing Sheets

INFANT SHOE HAVING A PIVOTING HEEL PORTION

BACKGROUND OF THE INVENTION

1. Field of the Invention

This invention relates to an infant shoe having a pivoting heel portion to allow easier entry and securing of the shoe to an infant's foot.

2. Description of the Related Art

Shoes are known to have an opening in a rear portion of the shoe that allows the foot entry into the opening. For example, U.S. Pat. No. 5,184,410 discloses a pivoting shoe construction having a shoe heel portion, a forward section, and pivot hinge. Each of the first and second bifurcated edges of the forward section include a release button opening cooperative with a respective release button mounted on the heel portion. The release buttons may be of a spring-biased type wherein depressing of each release button projects each button below each associated opening to permit pivot movement of the heel portion with respect to the forward section.

However, infants require assistance when putting on their footwear. In a situation where a parent is holding the infant while trying to put on the infant's shoe, the parent will have to hold the infant with one hand leaving the parent to put the shoe on the infant with only the other hand.

Related art shoes do not provide for a feature to sufficiently secure an infant's foot in a shoe with the parent only using one hand. For example, U.S. Pat. No. 2,357,980 discloses a baby shoe that includes a pivoting heel portion as shown in FIG. 2. In order to secure the shoe on the infant's foot after it is placed on the infant's foot, the shoelace that is laced through the tongue must then be laced through the eyelets formed in the pivoting heel portion. However, with the above discussed shoe, it is not practical to expect a parent to secure this type of shoe to the infant's foot if only one hand is available.

Therefore, shoes in the related art do not provide for a feature that allows a parent to put it on and secure it to the infant's foot with one hand while holding the infant with the other hand. Accordingly, in view of the foregoing disadvantages inherent in the shoes of the related art, there is a need for a new and improved infant shoe construction that addresses the deficiencies of the related art discussed above.

SUMMARY OF THE INVENTION

According to an aspect of the invention, it has been recognized that prior shoes suffer from one or more disadvantages including: having mechanical latching means that require releasing mechanisms to pivot a heel portion, and/or requiring lacing for a front portion of the shoe and a heel portion before the shoe will be secured to the foot.

The present invention relates to an improved shoe for an infant. According to an example, the infant shoe includes a pivoting heel portion that can be secured to an infant's foot by a person holding the infant. For example, an adult holding the infant with one hand can open the shoe, place the shoe on the infant's foot, and secured the shoe to the infant's foot, all with the other hand.

According to an example, at least a portion of the shoe is made of a flexible material to allow the shoe to pivot open. For example, one or more areas of an upper of the shoe can be made of leather.

According to a further example of the invention, a bottom portion or sole of the infant shoe can be made of a material such as cloth. A further example provides a bottom of the shoe made of suede leather. Another example provides an infant shoe with a rubber bottom. In an even further example, the bottom portion of the shoe can be made from a combination of materials.

In one example, the pivoting heel portion can be secured to the forefoot portion of the shoe by a securing device. By way of example, the securing device can be Velcro formed on at least a portion of the pivoting heel secured to Velcro formed on the forefoot portion of the shoe. According to an embodiment, the Velcro areas can be secured through one or more layers of the forefoot and/or heel portion of the shoe by way of stitching.

In an alternate embodiment, a zipper can be provided as the securing device. As a further example, hooks and loops can be used to secure the pivoting heel portion to the forefoot portion.

An example of the invention provides an infant shoe formed substantially similar to a slipper, which defines a pocket for the infant's foot. For example, in an embodiment, there is no tongue provided with the infant's shoe to help avoid any part of the shoe from becoming entangled with any part of the parent, infant and/or clothes of either the parent or infant.

An example of the invention provides for one or more layers located in an area substantially between the sole and upper, that extends around at least part of the circumference of the shoe. As an example, one layer may extend continuously around the circumference while another layer may extend around only a forefoot area of the upper.

An example of the invention provides for an infant shoe for an infant from zero to twelve months, more particularly for an infant from zero to nine months, and even more particularly for an infant from zero to seven months.

It should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed here are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying Figures. These are provided solely as non-limiting examples of the invention. In the drawings.

DETAILED DESCRIPTION OF THE PREFERRED EMBODIMENTS

Figure 1:
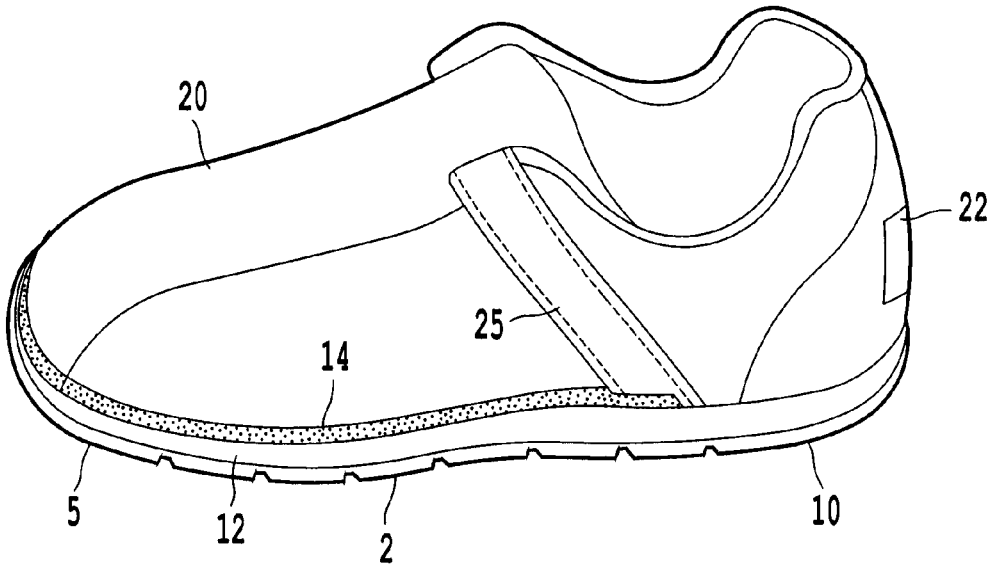
FIG. 1 is a schematic showing an infant shoe having a pivoting heel portion according to an example of the invention.

Reference will now be made in detail to the present preferred embodiments of the invention, examples of which are illustrated in the accompanying drawings. Wherever possible, the same reference characters will be used throughout the drawings to refer to the same or like parts.

As discussed earlier, the ability to place a shoe on the infant with one hand while holding the infant with the other, has been identified as difficult for a parent to accomplish. Additionally, once the shoe is on the foot, securing the shoe to the foot with one hand is also difficult.

Accordingly, the pivoting heel infant shoe preferably allows a parent to open hold the shoe with one hand and pivot open a rear portion of the shoe to allow the infant's foot to slide therein. Further, the parent can close the pivoted heel portion and secure the heel to the forefoot portion of the shoe to thereby secure the shoe to the infant's foot without having to put down the infant.

Figure 2:
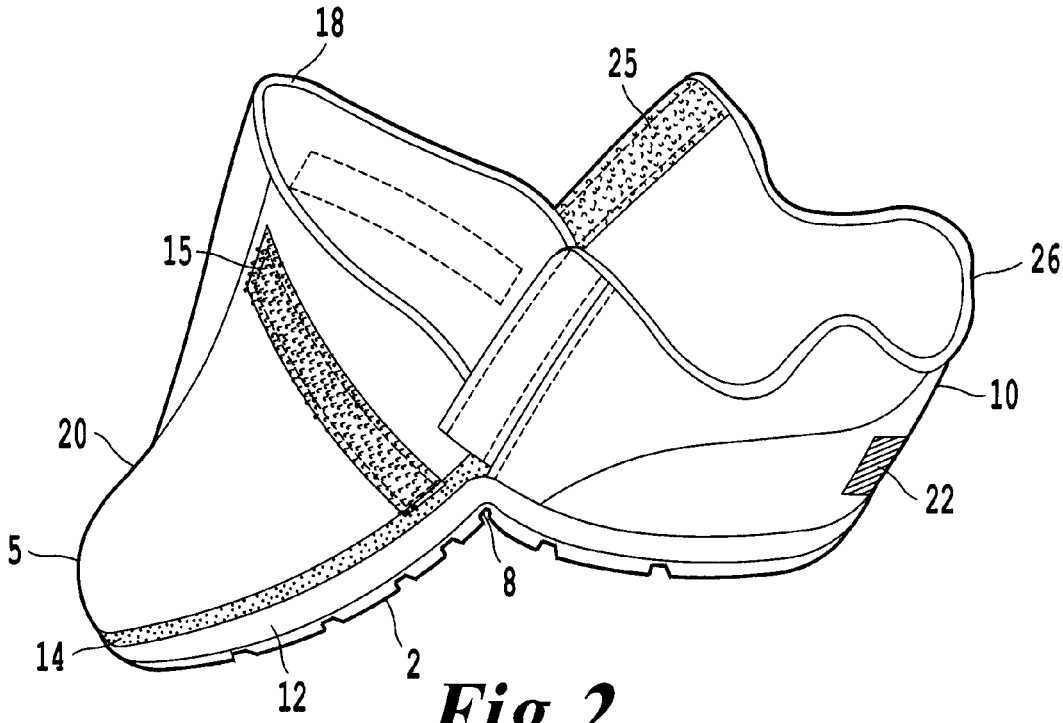
FIG. 2 is a schematic showing an infant shoe with the heel pivoted according to an example of the invention.

FIGS. 1 and 2 are schematics showing pivoting heel infant shoe according to an example of the invention. The pivoting infant shoe shown in FIG. 1 is generally for infants, for example infants from 0 to 12 months old. However, the infant shoe of the present invention can be used for a child of any age that might benefit from the advantages provided by shoes of examples set forth below, for example, for a child up to 15 months old.

As shown in FIGS. 1 and 2, the infant shoe is may include a toe portion 5, a heel portion 10 and a sole 2. As an example, the sole 2 may be made of a cloth material. As a further example, the sole 2 may be made of suede leather. Further, the sole 2 could be made of rubber. For example, the sole 2 could be made of a thin piece of rubber to provide traction between the sole 2 and a walking surface. Using a thin piece of rubber as the sole 2, will help maintain the overall structure and shape of the shoe without adding an undesirable amount of weight to the shoe. As an even further example, the sole 2 could have decorative screen print graphics formed thereon. As discussed in further detail below with respect to a further example, in addition to the sole 2, other layers of the shoe can be formed to have the decorative screen print graphics.

It should be appreciated that the sole 2 can be made of any type of material that will provide a desirable amount of grip between the sole 2 and a contact surface. Further, an example of the invention includes a sole 2 that includes one or more different materials in various areas of the sole to differ the feel and/or performance of the shoe for the infant. In an embodiment of the invention, the toe region 5 could have a thin rubber as the material, while the heel portion 10 could have a cloth material to facilitate the pivoting of the heel portion 10 with respect to the toe portion 5. That is, the area of the sole 2 that will bend and form a crease 8 should be flexible. In this example, if the sole 2 in the toe portion 5 is made from thin rubber and the heel portion of the sole 2 is made from cloth, a place where the two materials intersect can be formed in the crease 8. In this way, the heel can be more easily pivoted due to less resistance offered by the cloth as compared to the thin rubber. Forming the sole 2 in this way can provide a consistent crease area 8 to be relied upon by the parent when placing the shoe on the foot.

The bottom of sole 2 may include a texture or pattern to help improve friction between the sole 2 and the contact surface. For example, if the sole 2 is formed from a cloth material, a pattern could be heat-pressed to form ridges. Similarly, a rubber or leather sole 2 could be molded or shaped by any known method to have any desirable pattern. As further example, if the sole 2 is made of different material, the areas of the sole 2 having the different material can also have a different pattern formed thereon. In this way, the amount of friction or grip generated between the sole 2 and a contact surface can be varied for different areas of the shoe to provide a desirable feel to the shoe. While the examples described include a texture or pattern for the sole 2, a further example of the invention does not have a pattern formed on the sole 2.

As shown in FIGS. 1 and 2, an example of the invention provides a bead layer 12 formed above the sole 2. In an example of the invention, the bead layer 12 can extend continuously around a perimeter of the sole 2. In another example, the bead layer 12 can extend around only a portion of the perimeter of the sole 2 of the infant shoe. The bead layer 12 can be attached to the upper 20 to provide a secure connection between the sole 2 and upper 20. For example, during manufacturing, the sole 2 and upper 20 could be stitched together. It should be appreciated that the sole 2 and upper 20 could be secured by gluing or any other suitable means to connect them together. Additionally, forming the bead layer 12 around a perimeter of the shoe above the sole 2 helps define a bottom area of the shoe. The bead layer 12 could be made to have a different color than adjacent and/or the rest of the shoe. In an embodiment of the invention, the bead layer 12 is made from a different material than the remaining portions of the shoe. For example, the bead layer 12 could be made from a material that is less flexible than the for example sole 2 and/or upper 20. In this way, the bead layer 12 will help hold the shape of the shoe. It should be appreciated that even if the bead layer 12 is formed of a less flexible material, it still should be able to deform to allow the heel portion 10 to pivot. As such, the infant's foot can be slide into a well defined shoe without the need for the parent to manipulate the shoe in any way other than opening the heel portion 10 to let the foot slide therein.

Another example of the invention provides an infant shoe having the sole 2 and bead layer 12 formed as one piece. In this example, after forming the single layer, they can be secured to the remaining portions of the shoe, for example, to the upper 20 in a similar manner as discussed above. By forming these elements as one piece, the manufacturing process can be simplified and the costs can be reduced. As a further example of the invention, the sole 2, bead layer 12, toe portion 5, and heel portion 10 can all be formed as a single piece. It should be appreciated that any number of these portions of the shoe can be formed as one piece. For example, the upper layer 14 discussed below, can also be formed with other portions of the shoe as an integral unit. Additionally, an example of the invention provides for decorative screen printed graphics to be provided for one or more of the sole 2, toe portion 5, heel portion 10, upper layer 14, and bead layer 12. As an example, the sole 2 could be provided with a tread pattern that is a decorative screen printed graphic. The tread pattern could be any color, pattern, size, shape, and can include logos and/or words. Further, the area of the bead layer 12 could also have decorative screen printed graphics with any desirable color, pattern, or style. Forming this area in a different color than the sole area 2 can provide a contrast between the different areas and define the sole 2.

In another example of the invention, an upper layer 14 can be formed around at least a portion of the upper 20. The upper layer 14 can be formed above the bead layer 12 to provide a solid shape for the shoe and help hold the shape of the shoe for the infant. In the example shown in FIGS. 1 and 2, the upper layer 14 is formed as a non-continuous layer. That is, the upper layer 14 extends only around a perimeter of the infant shoe in the toe region 5 of the upper 20. The upper layer 14 does not extend around the pivoting heel portion 10 of the shoe. Providing the upper layer 14 only around the toe region 5 and not the pivoting heel region 10, allows the heel portion 10 to be bent down or pivoted to a desirable position with respect to the toe region 5 without generating undesirable resistance to the parent pivoting the shoe. Similar to the bead layer 12, the upper layer 14 can be formed of a material that will help the shoe hold its shape and provide support for the shoe. For example, the upper layer 14 can be made of a material less flexible than material of adjacent portions of the shoe. Further the upper layer 14 can be any color to further define a region of the shoe. The upper layer 14 can also be of a same or different size than the bead layer 12. In an embodiment of the invention, the upper layer 14 can be secured to the bead layer 12. Securing these two layers together can aid in providing a desirable shape and support to the shoe. Alternatively, or in addition to, the upper layer 14 can be secured to the upper 20. Similar to the bead layer 12, the upper layer 14 can be secured to other portions of the shoe by stitching, gluing, or any other suitable means.

In an interior of the shoe, any material can be used that will provide a comfortable feel to the infant, provide warmth, and/or keep out the elements. Further, in the interior, any number of layers can be formed in order to provide surfaces for other layers to connect to. For example, a layer can be formed on an upper surface of the sole that faces the interior of the shoe. This layer can facilitate the connection between the sole 2 and upper 20 and can be formed of a nylon material and/or a synthetic mesh material. Further, a midsole or padding layer can be provided that contacts a bottom of the infant's foot. The midsole or padding can be stitched to one or more other areas of the shoe that will provide comfort for the infant.

As a further example, an edge 18 formed in an area between the upper 20 and the interior of the shoe, can be formed of a different material than the surrounding areas. For example, if an interior of the shoe is made from a cloth material, the edge 18 could be made from a leather material. When an infant's foot is being inserted into the shoe, an upper part of the foot is likely to contact the edge 18 area of the shoe. Forming this area of a material that is less likely to generate resistance or snag on the infant's clothing can allow the infant's foot to slide more easily into the shoe.

As generally shown in the examples of FIGS. 1 and 2, the toe portion 5 of the upper 20 is mostly formed as a single piece that is configured to receive the infant's foot without the need for a parent to manipulate the shoe to get the foot in. In an example of the invention, the toe portion 5 of the upper 20 of the infant shoe does not include a tongue or other loose features that might interfere with an infant's foot sliding into the shoe and remaining in the shoe prior to the heel being connected thereto. Additionally, it will not be necessary for the parent to fold down or otherwise move a tongue out of the way while trying to insert the infant's foot. In this way, an example of the invention provides an infant shoe formed substantially similar to a slipper, which defines a pocket for the infant's foot to reside therein.

As previously discussed, one or more examples of the invention are directed to an infant's shoe that includes a pivoting heel portion that can be secured to an infant's foot with one hand while holding the infant with the other. Accordingly, the material used to form the areas of the shoe for pivoting, should be made of flexible material. As an example, parts of the upper 20 and the sole 2 in the area of the toe portion 5 and heel portion 10 can be made of leather.

In order to facilitate the opening of the shoe with one hand, an example of the invention provides a patch of material 22 can be placed on at least a portion of the heel portion 10. The patch of material 22 can be material that will provide a good gripping area for the persons hand or fingers when they are opening the shoe. As an example, the material 22 can be a cloth material or a thin piece of rubber. It should be appreciated that a patch of material 22 could also be placed on the upper 20 in the toe region 5. Accordingly, a parent can place one or more fingers in the toe portion 5 and one or more fingers in the heel portion 10 on the patch of material 22 and bend open the shoe without the hand or fingers slipping, to allow the foot to slide therein.

In another example of the invention, instead of a patch area of material 22, a groove or indentation can be formed in the area shown by the patch 22 and/or in on the toe portion 5 in order to provide a gripping area for the parent. As a further example, small protrusions or bumps could be formed on the surface of the heel 10 and/or toe portion 5 to help reduce or prevent the hand or fingers from slipping. As an even further example, the contour of an upper ridge 26 of the heel portion 10 can be formed to have an indentation or groove that will allow the parent to securely pull down the heel portion 10 and open the shoe.

As best shown in FIG. 2, the shoe can be pivoted open to a sufficient degree to allow a foot to be slide therein. After the foot is in the shoe, the heel portion 10 can be pivoted back to a closed position and secured to the remainder of the shoe. In one example, the pivoting heel portion 10 can be secured to the forefoot or toe portion 5 of the shoe by a securing device. By way of example, the securing device can be Velcro. The Velcro can be placed on at least a portion 25 of the pivoting heel and also on at least a portion 15 of the toe portion 5. As shown in FIG. 2, the Velcro portion 25 of the heel is formed on an inside of side portions of the pivoting heel 10 that will face the infant's foot. The Velcro portion 15 located on the upper 20 of toe region 5 can be formed on an outside surface of the upper 20 facing away from the inside of the shoe. According to this example, when the heel portion 10 is rotated closed, the portion of the heel 10 having the heel Velcro portion 25 will overlap to the outside of the Velcro portion 15. In this way, with the infant's foot already in the shoe, a parent can easily press together the areas of the shoe having the Velcro portions, with for example the index finger on one side of the shoe and the thumb on the other with the infant's foot providing a firm backdrop behind both portions of Velcro, the shoe can be secured together with one hand. In an alternate embodiment, the Velcro 15 could be provided on an inside surface of the upper 20 of the toe portion 5, and the Velcro 25 could be provided on an outside surface of the heel portion 10 so that the heel portion 10 will slide inside the toe portion 5.

As shown in FIG. 2, the Velcro attachment 15 can extend from an area at or near the bead layer 12 and upper layer 14, to an area near the top of the upper 20. Similarly, the Velcro attachment 25 can extend the length of the heel portion 10 from an area at or near the sole 2 to an upper region of the heel portion 10. It is preferable to have the Velcro portion 15 and 25 to be of similar size and shape in order to avoid exposed areas of the Velcro that could become snagged with, for example, the infant's socks or pants or the parent's shirt. However, it should be appreciated that the Velcro 15 and/or 25 can be any shape or size and located at any area of the toe portion 5 and heel portion 10 in order to facilitate a secure connection between the heel and toe portions of the shoe. Accordingly, as set forth in the examples above, the Velcro can be attached at any area of the shoe and for any length of the side of the shoe to provide a secure connection with the pivoting heel portion. Having the heel pivot to an open position allows the infant foot to slide into the upper before the heel portion is moved back to a wearing position and secured together by the user by utilizing the securing device.

The Velcro 15 formed on the toe portion 5 of the shoe can be stitched through all or some of the layers of the upper in order to provide a secure connection between the layers. Similarly, the Velcro portion 25 of the heel portion 10 can be secured, for example by stitching, through the layers of the heel portion 10. Alternatively, the Velcro 25 can be formed as a separate piece stitched to an end of the heel portion 10. When the Velcro layers 15 and 25 are stitched through the layers of the shoe, this provides not only a secure connection between the Velcro area 15 and 25 with the shoe but also increases a secure connection of the shoe as a whole when the Velcro area are fastened together.

Figure 3A:
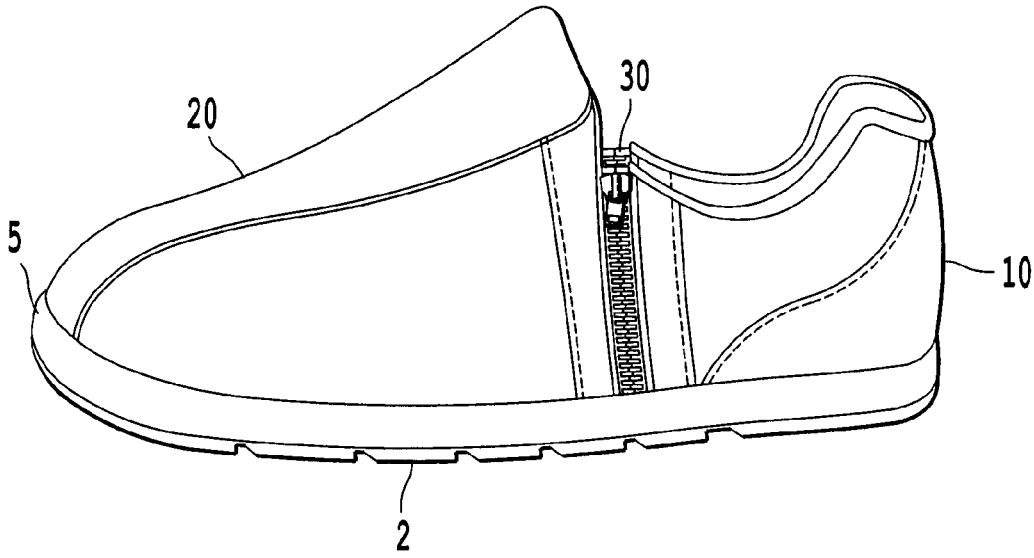
FIGS. 3A and 3B are schematics showing a further example of the invention.
Figure 3B:
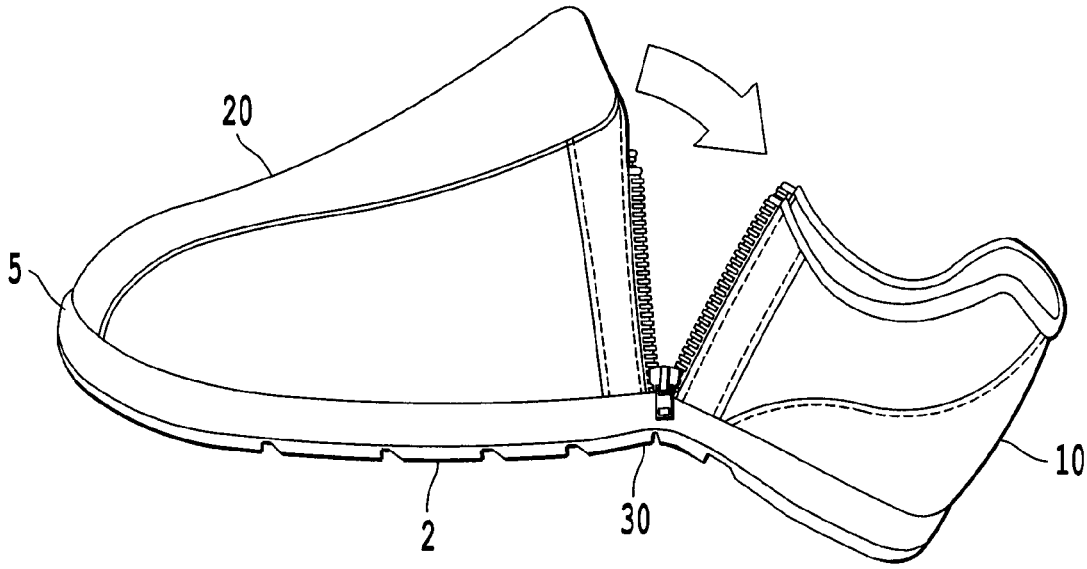

FIGS. 3A and 3B show an alternative embodiment of the invention. In this embodiment, a zipper can be used to secure the pivoting heel portion 10 to the toe portion 5 of the shoe. That is, after the heel is pivoted and the infant foot is slid therein, the zipper can be utilized to secure the heel to the forward portion. It should be appreciated that any type of fastener can be used to secure the heel portion 10 to the toe portion 5. For example, hooks and loops can be used to secure the two pieces together. As an example, hooks can be formed on one of the heel 10 or the toe 5 portion. It is preferable that the hooks are formed so that they face away from the infant's foot, which would allow the loops to be facing the skin of the infant. In an alternative embodiment, the hooks can be covered up by a flexible material in order to protect the infant from scratching or any other contact made by the infant with the hooks and loops. As an even further embodiment, clasps can be used to secure the heel portion 10 with the toe portion 5.

Figure 4:
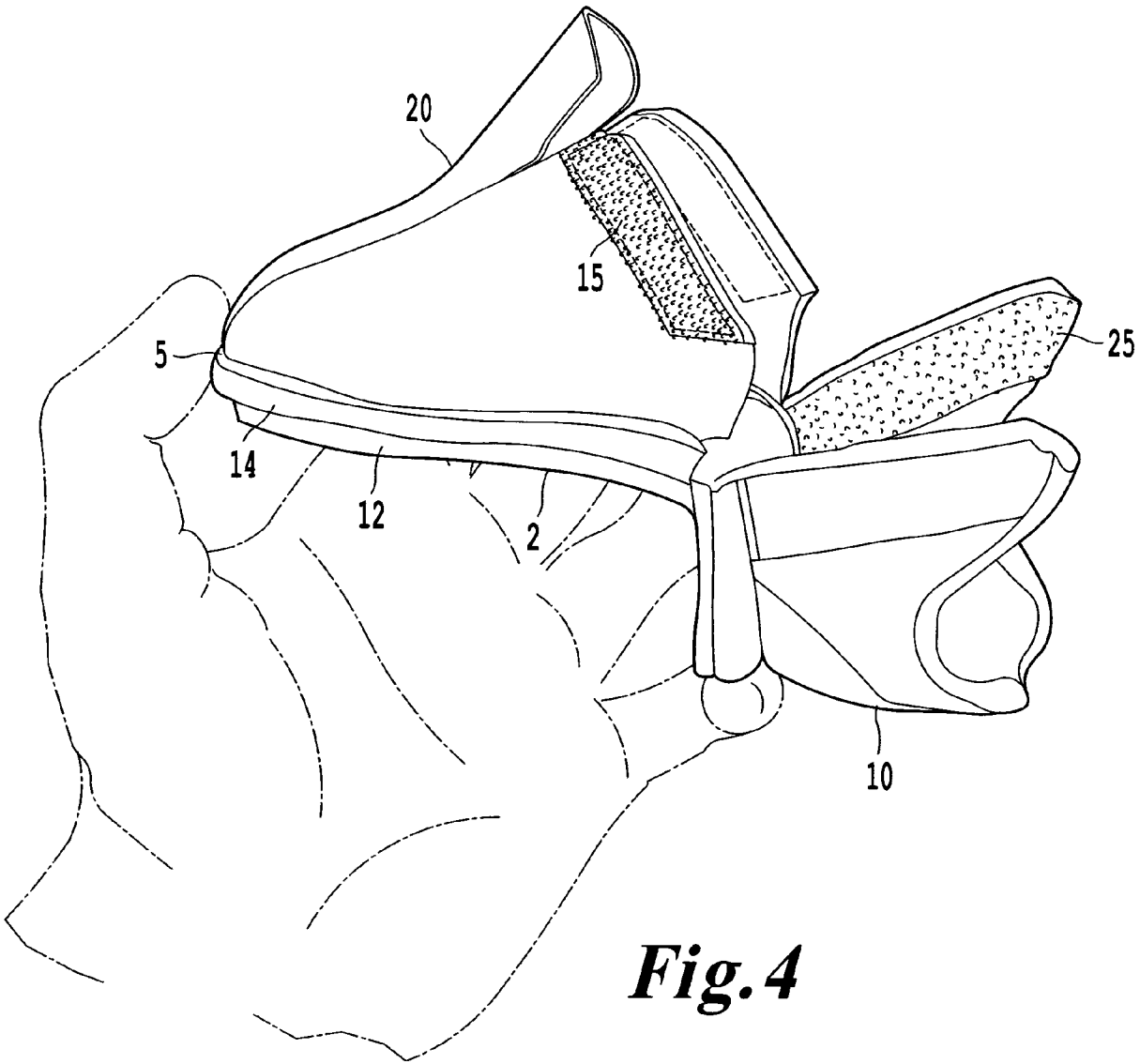
FIG. 4 is a schematic showing a person's hand gripping the shoe and opening the infant shoe with one hand according to an embodiment of the invention.

As shown in FIG. 4, and as discussed in embodiments of the invention, an adult can open the infant shoe with one hand providing a significant bend in the sole of the shoe and thereby providing an opening for the infant's foot to be placed therein. After the infant's foot is placed therein, the heel can be moved back into a wearing position and can be secured with the toe portion 5 by way of the Velcro and/or other securing devices discussed in examples of this invention.

While exemplary embodiments of the invention have been described in conjunction with the embodiments outlined above, it is evident that many alternatives, modifications and variations will be apparent to those skilled in the art. Accordingly, exemplary embodiments of the invention, as set forth above, are intended to be illustrative, not limiting. Various changes may be made without departing from the spirit and scope of the invention.

The invention claimed is:

1. A shoe with a pivotal heel portion, comprising:

a sole;

an upper secured to the sole, the upper including a forefoot portion and a heel portion, the heel portion is configured to pivot with respect to the forefoot portion such that a ground engaging portion of the sole pivots along with the heel portion of the upper;

a first support layer formed around at least an outer periphery of the sole and connected to the sole and the upper;

a second support layer formed above the first support layer and around a portion of a periphery of the upper, the second support layer being secured to the upper; and at least one securing device associated with the forefoot portion configured to engage with at least one securing device associated with the heel portion, wherein the securing device associated with the forefoot portion is located on each lateral side of the forefoot portion extending upwardly along a lateral side surface from a position adjacent the second support layer for a distance substantially an entire length of the lateral side of the forefoot portion, wherein after a foot has been inserted into the forefoot portion of the shoe, the heel portion can be pivoted to a substantially closed position such that when the shoe is in a position to be secured together, each side wall of the heel portion having the securing device, overlap with an entire area of the securing device of the forefoot portion.

2. The shoe according to claim 1, wherein the at least one securing device associated with the forefoot and heel portions is a hook and loop securing device.

3. The shoe according to claim 2, wherein the securing device associated with the forefoot portion is located on each lateral side of the forefoot portion and faces away from the inside of the shoe and the securing device associated with the heel portion is located on side walls of the heel portion and is facing the inside of the shoe.

4. The shoe according to claim 3, wherein when the shoe is in a position to be secured together, the side walls are pushed in a direction towards the inside of the shoe so that the securing device associated with the heel portion engage the securing device associated with the forefoot portion.

5. The shoe according to claim 1, wherein the at least one securing device is a zipper that connects the heel portion to the forefoot portion.

6. The shoe according to claim 4, further comprising a gripping area, the gripping area formed on at least the heel portion above the first support layer, wherein the gripping area formed on the heel portion faces in a rearward direction of the shoe.

7. The shoe according to claim 6, wherein the gripping area is formed of a material different from a material of the upper.

8. The shoe according to claim 7, wherein the material of the gripping area is one or cloth or rubber.

9. The shoe according to claim 6, wherein the gripping area is formed of a groove or indentation.

10. The shoe according to claim 6, wherein the user opening the shoe can place one or more fingers from one hand in the gripping area and open the shoe with the one hand.

11. The shoe according to claim 1, wherein at least a portion of the shoe is made of a flexible material.

12. The shoe according to claim 11, wherein the at least a portion of the shoe is made of leather.

13. The shoe according to claim 11, wherein the sole of the shoe is made from one of cloth, suede leather, and rubber.

14. The shoe according to claim 13, wherein the sole can be made from a plurality of materials.

15. The shoe according to claim 1, wherein the shoe is a shoe for an infant from 0 to 12 months.

16. The shoe according to claim 1, wherein the upper is formed as a smooth surface at least in an area around the opening to the forefoot portion.

17. The shoe according to claim 1, wherein the first support layer is secured to both the sole and the upper layer by at least one of stitching and gluing.

18. The shoe according to claim 1, wherein the first support layer is secured to the forefoot portion and heel portion, and the second support layer is secured to only the forefoot portion.

19. The shoe according to claim 18, wherein the first and second support layers are secured together by at least one of stitching and gluing.

20. The shoe according to claim 19, wherein stitching that secures the securing device to the forefoot portion extends through each layer that forms the forefoot portion.

21. The shoe according to claim 1, wherein the sole and first support layer are formed as a single piece.

22. The shoe according to claim 21, wherein a decorative screen printed graphic is formed on at least one of the sole and first support layer.

23. The shoe according to claim 1, wherein the sole, first support layer, and upper are formed as a single piece.

24. The shoe according to claim 1, wherein the ground engaging portion of the sole pivots along with the heel portion of the upper at substantially an arch area of the shoe.

* * * * *

UNITED STATES PATENT AND TRADEMARK OFFICE

CERTIFICATE OF CORRECTION

PATENT NO. : 8,161,669 B2
APPLICATION NO. : 11/970984
DATED : April 24, 2012
INVENTOR(S) : Brian Keating It is certified that error appears in the above-identified patent and that said Letters Patent is hereby corrected as shown below:

On the face of the patent, (73) Assignee, change "X-Swiss, Inc.," to --K-Swiss, Inc.,--.

Signed and Sealed this
Seventeenth Day of July, 2012

David J. Kappos

David J. Kappos
*Director of the United States Patent and Trademark Office*